US009835330B2

(12) United States Patent
Guzorek et al.

(10) Patent No.: US 9,835,330 B2
(45) Date of Patent: Dec. 5, 2017

(54) LINEAR SLIDE DAMPER SYSTEM

(71) Applicant: FIELD CONTROLS, LLC., Kinston, NC (US)

(72) Inventors: Steven E. Guzorek, Kinston, NC (US); Cory A. Weiss, Warren, MI (US)

(73) Assignee: FIELD CONTROLS LLC, Kinston, NC (US)

( * ) Notice: Subject to any disclaimer, the term of this patent is extended or adjusted under 35 U.S.C. 154(b) by 620 days.

(21) Appl. No.: 14/284,984

(22) Filed: May 22, 2014

(65) Prior Publication Data

US 2014/0352684 A1 Dec. 4, 2014

Related U.S. Application Data

(60) Provisional application No. 61/829,036, filed on May 30, 2013.

(51) Int. Cl.
*F24F 13/12* (2006.01)
*F23L 13/06* (2006.01)

(52) U.S. Cl.
CPC ..... *F23L 13/06* (2013.01)

(58) Field of Classification Search
CPC ..... B60G 2202/24; B60G 2002/41; E05Y 2201/264; F24F 13/10; F24F 13/12
USPC ..... 122/155.1, 155.2, 135.1; 126/286, 285 R
See application file for complete search history.

(56) References Cited

U.S. PATENT DOCUMENTS 3,339,785 A * 9/1967 Nugent ..... A61L 2/26 220/232
4,185,769 A * 1/1980 Nezworski ..... F23L 11/005 236/1 G
4,235,256 A * 11/1980 Crawshay ..... F16K 3/0281 126/285 A
4,262,608 A * 4/1981 Jackson ..... F23J 13/025 110/162
4,491,144 A * 1/1985 Dreyer ..... F16K 3/0281 126/285 A
5,218,998 A * 6/1993 Bakken ..... F24F 13/12 137/625.28
5,427,146 A * 6/1995 Bakken ..... F24F 13/12 137/625.3
5,881,806 A 3/1999 Rudd
D409,073 S 5/1999 Bluestone
6,035,849 A 3/2000 Bluestone
6,082,704 A 7/2000 Grinbergs
6,089,537 A * 7/2000 Olmsted ..... F16K 3/10 251/129.11
6,260,490 B1 * 7/2001 Wark ..... F16K 3/10 110/101 R
6,409,143 B1 6/2002 Beck et al.
(Continued)

FOREIGN PATENT DOCUMENTS

CA 2750181 A1 * 3/2012 ..... F24H 1/205

*Primary Examiner* — Gregory A Wilson
(74) *Attorney, Agent, or Firm* — Brinks Gilson & Lione

(57) ABSTRACT

A damper system comprises a damper blade having open and closed states. The damper blade is movable in a linear direction only between the open and closed states. The damper blade may fully overlap with a flue passage in the closed state, and the damper blade may lack any overlap with the flue passage in the open state. A portion of the damper blade may directly contact a switch activation arm in the open state, wherein the switch activation arm confirms the open state of the damper blade.

15 Claims, 4 Drawing Sheets

(56) References Cited

U.S. PATENT DOCUMENTS

| | | | | |
|---|---|---|---|---|
| 6,431,268 | B1 | 8/2002 | Rudd | |
| 6,557,501 | B2 | 5/2003 | Hughes | |
| 6,644,957 | B2 | 11/2003 | Weiss | |
| 6,745,724 | B2 | 6/2004 | Hughes et al. | |
| 6,749,124 | B2 | 6/2004 | Weiss | |
| 6,749,125 | B1 | 6/2004 | Carson et al. | |
| 6,915,799 | B2 | 7/2005 | Weiss | |
| 7,258,280 | B2 | 8/2007 | Wolfson | |
| 7,451,759 | B2 | 11/2008 | Weiss et al. | |
| 7,721,972 | B2 | 5/2010 | Bracken et al. | |
| 8,113,823 | B2 | 2/2012 | Guzorek | |
| 8,297,524 | B2 | 10/2012 | Kucera et al. | |
| 8,807,987 | B2 * | 8/2014 | Lehman | F23N 1/025 126/285 A |
| 2013/0048743 | A1 | 2/2013 | Kucera et al. | |

* cited by examiner

LINEAR SLIDE DAMPER SYSTEM

PRIORITY CLAIM

This invention claims the benefit of priority of U.S. Provisional Application Ser. No. 61/829,036, entitled "Linear Slide Damper System," filed May 30, 2013, the disclosure of which is hereby incorporated by reference in its entirety.

BACKGROUND

The present embodiments relate generally to a damper system, and more specifically, to a linear slide damper system.

Dampers have been used for many years to reduce heat loss during the off cycle period of gas-fired equipment. Vent dampers are typically mounted above the draft hood or draft diverter on gas-fired equipment such as furnaces and boilers and flue dampers are mounted between the equipment flue outlet and the draft hood on gas-fired commercial water heating equipment.

A newer use of the flue dampers are for residential style water heating equipment. Unlike the applications on commercial water heaters, the size of the draft hood is much smaller on the residential style heaters, and therefore the damper does not mount underneath the draft hood as they typically do on commercial heaters. Because of the size of the draft hood, the draft hood may need to be mounted directly onto the damper assembly. This mounting method raises the hood from the top of the water heater, thereby affecting the vent pipe mounting height and shipping carton sizes, which are both undesirable features to the water heater manufacturers.

Current damper product designs use a rotating shaft attached to the damper blade and rotate the damper through a 360 degree rotation open and closed, or it operates the damper through a 90 degree rotation open and closed with a spring return method. The circular shape of the rotating damper method increases the height of mounting the draft hood and requires a precise positioning of the damper when the damper blade stops in the open position. If the open position of the damper blade varies off of the true vertical open position, it causes an increased restriction to the flue gas flow. This venting path restriction can cause poor combustion and increased potential of flue gas spillage from the draft hood.

SUMMARY

A damper system comprises a damper blade having open and closed states. The damper blade is movable in a linear direction only between the open and closed states. The damper blade may comprise a rectangular shape. The damper blade may fully overlap with a flue passage in the closed state, and the damper blade may lack any overlap with the flue passage in the open state.

A drive member is coupled to the damper blade, and rotation of the drive member in a circumferential direction imparts linear motion to the damper blade. In one embodiment, the damper blade comprises first and second ends, a solid segment disposed at the second end, and a slot disposed at the first end. The drive member comprises at least one pin disposed for movement within the slot of the damper blade. In one embodiment, a circumferential position of the drive member may vary by at least 5 degrees while the damper blade remains in a fully open state.

In one embodiment, a portion of the damper blade directly contacts a switch activation arm in the open state, wherein the switch activation arm confirms the open state of the damper blade. A first end of the damper blade may contact a tapered segment of the switch activation arm when the damper blade is in the open state.

Advantageously, the linear slide damper assembly may comprise a reduced height when disposed between a water heater and a draft hood. Further, the damper blade may be entirely removed from the air stream of the flue passage when in the open state. Still further, the drive system can allow at least a 5 degree variation, and up to a 20 degree variation or more, in the positioning of the drive member while still maintaining a completely open state of the damper blade.

Other systems, methods, features and advantages of the invention will be, or will become, apparent to one with skill in the art upon examination of the following figures and detailed description. It is intended that all such additional systems, methods, features and advantages be within the scope of the invention, and be encompassed by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
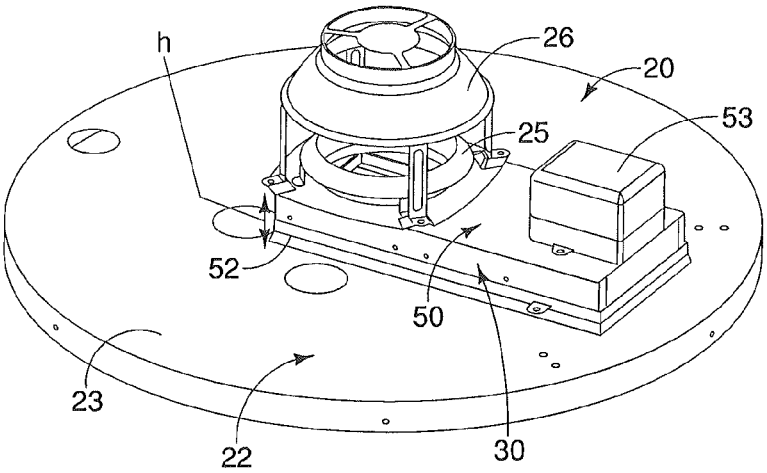
FIG. 1 is a schematic perspective view of a first embodiment of a system comprising a linear slide damper, as shown coupled to a portion of a water heater.

Referring to FIG. 1, a schematic perspective view of a first embodiment of a system 20 comprising a linear slide damper assembly 30 is shown and described. The linear slide damper assembly 30 is shown coupled to an upper surface 23 of a water heater tank 22. It will be appreciated that, while the linear slide damper assembly 30 is shown as being coupled to a water heater tank in the example described herein, the linear slide damper assembly 30 may be used in other systems and applications.

A cover 50 may be mounted to the upper surface 23 of the water heater tank 22 in order to enclose components of the linear slide damper assembly 30. The cover 50 may include a main housing 52 and a motor housing portion 53, as shown in FIG. 1. The main housing 52 encloses a majority of the components of the linear slide damper assembly 30, and comprises a height h, as shown in FIG. 1. The height h of the main housing 52 used with the linear slide damper assembly 30 is considerably shorter than a housing that would be used with a conventional rotary-style damper assembly. In particular, the damper blade sizes used on residential water heaters generally range between about 3 inches to about 4 inches in diameter, so by eliminating the rotating blade of a rotary damper, for which circumferential rotation impacts vertical height above the water heater 22, the height of the present linear damper system may be reduced between about 1.5 inches to about 2 inches, or approximately one-half of the damper blade diameter.

Figure 2:
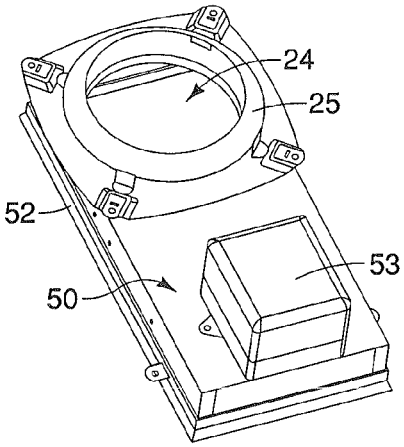
FIG. 2 is a schematic perspective view of the linear slide damper of FIG. 1 with the water heater and hood of FIG. 1 removed for illustrative purposes.
Figure 3:
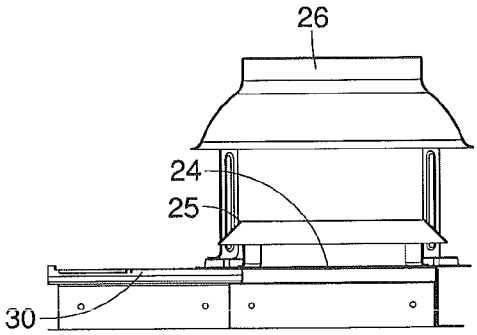
FIG. 3 is a side view of the system of FIG. 1.

A flue passage 24 is disposed at the upper surface 23 of the water heater tank 22. An inner draft limiting ring 25 is positioned adjacent to the flue passage 24, as best seen in FIG. 2. A draft hood 26 may be mounted to the main housing 52 at a position above the flue passage 24 and the inner draft limiting ring 25, as shown in FIGS. 1 and 3. It should be noted that the motor housing portion 53 may be offset from the draft hood 26, and therefore the motor housing portion 53 does not increase the overall height of the system 20 beyond the height h of the main housing 52 plus the draft hood 26.

Figure 6A:
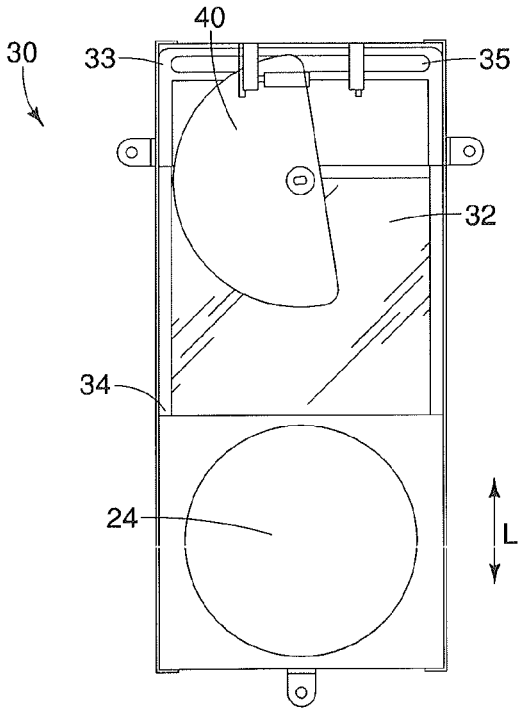
FIGS. 6A-6B are top schematic views of the linear slide damper in open positions.
Figure 6B:
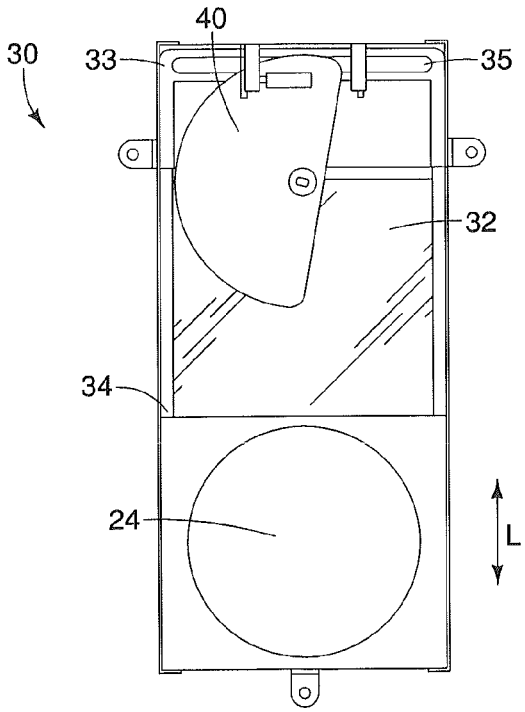

During use, when the linear slide damper assembly 30 is in an open position as shown in FIGS. 6A-6B below, flue gases flow through the flue passage 24 and through the inner draft limiting ring 25 towards the draft hood 26. The linear slide damper 30 does not reduce the effective open area of the flue passage 24 since the damper blade is completely removed from overlap with the flue passage 24 in the open position, as will be explained further below. By contrast, in a conventional rotary-style damper system, the effective surface area of the damper blade itself can reduce the outlet venting area by about 10% due to the presence of the rotary damper within the flue passage 24, and moreover, a 10 degree variation of the damper's vertical orientation from a true vertical position in the open state in a rotary system can reduce the effective open area by an additional 10%.

Under a down draft condition, flue gases from the flue passage 24 are restricted by air flow from a vent, which produces a downward capping pressure on the flue area, and a reduction in flue gas flow can be seen. To reduce the effect of the capping pressure during the down drafting condition, the inner draft limiting ring 25 is used to divert the downward flow of air from the vent away from the flue passage 24. Advantageously, the inner draft limiting ring 25 diverts the down flow of air away from the damper outlet and allows for the gases to vent horizontally out of the damper to reduce the capping pressure produced on the outlet of the damper.

Figure 4:
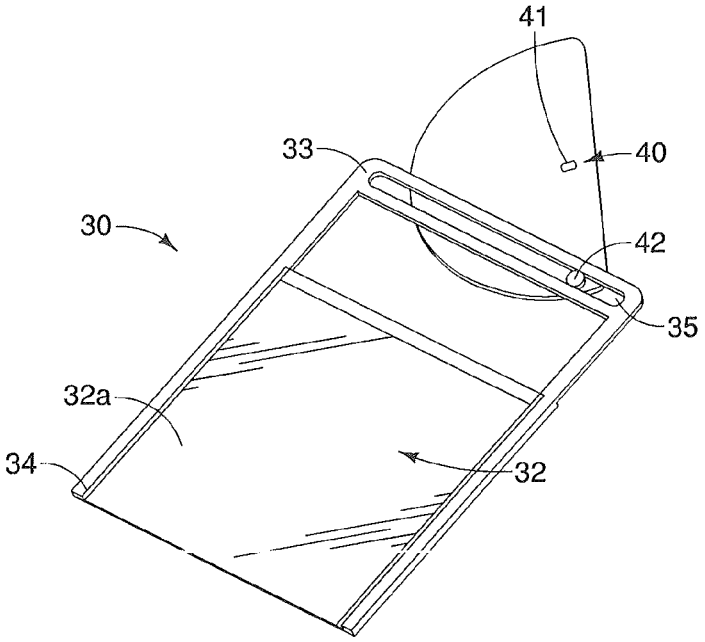
FIG. 4 is a schematic perspective view illustrating features of the linear slide damper of FIGS. 1-3 in further detail.
Figure 5:
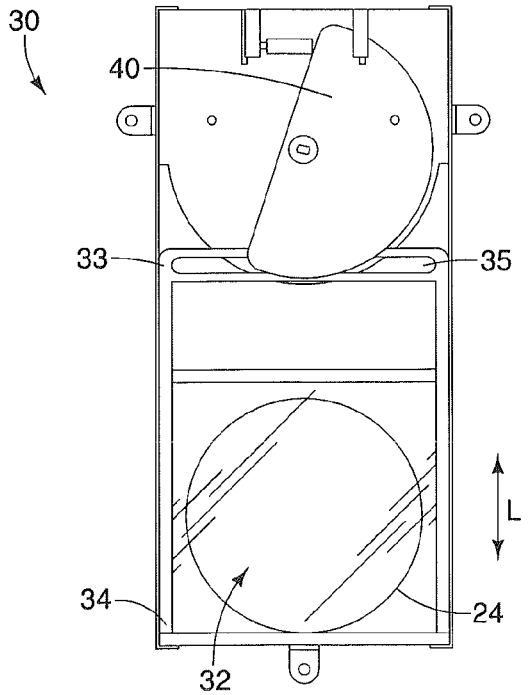
FIG. 5 is a top schematic view of the linear slide damper in a closed position.

Referring now to FIGS. 4-6, further features of the linear slide damper assembly 30 of FIGS. 1-3 are shown and described in further detail. Linear slide damper assembly 30 comprises a damper blade 32 having first and second ends 33 and 34, respectively. In this example, the damper blade 32 comprises a generally rectangular shape, which may facilitate being guided linearly within a channel and covering the flue passage, although it will be appreciated that other shapes may be employed.

The damper blade 32 comprises closed and open states, as shown in FIGS. 5-6, respectively. The damper blade 32 comprises a solid segment 32*a* that is dimensioned to cover the entirety of the flue passage 24 when the damper blade 32 is in the closed state, as shown in FIG. 5. The damper blade 32 is linearly movable along a longitudinal axis L, such that it moves from the closed state to an open state as shown in FIGS. 6A-6B.

The linear slide damper assembly 30 further comprises a drive member 40. In the examples shown herein, the drive member 40 comprises a shape that is slightly larger than semi-circular, with a location 41 corresponding to a center of a circle that would be defined if the drive member 40 were to comprise a full circle. A motor may be operatively coupled to the drive member 40 at the location 41, such that rotation of the motor causes corresponding rotation of the drive member 40 about the location 41.

The damper blade 32 further comprises a slot 35, which may be positioned at the first end 33 of the damper blade 32, and which extends in a perpendicular direction relative to the longitudinal axis L. It will be appreciated that while the exemplary slot 35 is shown as an integral opening disposed at the first end 33 of the damper blade 32, the slot 35 alternatively may comprise a separate opening or channel that is operatively coupled to the damper blade 32, whether at the first end 33 or another location, to achieve the functions described below.

The drive member 40 comprises a pin 42, which in the example shown is positioned at an outer periphery of the drive member 40. The pin 42 of the drive member 40 is disposed within the slot 35 of the damper blade 32.

In use, rotational movement of the drive member 40, e.g., via the motor, is translated into linear motion of the damper blade 32. Specifically, as the drive member 40 is rotated, the pin 42 rotates circumferentially about the location 41. As the pin 42 rotates, it moves in directions that are both parallel and perpendicular to the longitudinal axis L of the assembly. Since the pin 42 is secured within the slot 35 of the damper blade 32, the linear movement of the pin 42 relative to the longitudinal axis L causes a corresponding linear movement of the slot 35 along the longitudinal axis L. During this movement, the pin 42 may move laterally within the slot 35 as needed.

As the pin 42 and the slot 35 move linearly along the longitudinal axis L, the entirety of the damper blade 32 moves linearly along the longitudinal axis L. The damper blade 32 may be guided by channels, such as partially rectangular or C-shaped channels that at least partially enclose opposing sides the damper blade 32, to assure the linear movement path shown. In this manner, the solid segment 32*a* of the damper blade 32 is moved linearly between the closed and open states of FIGS. 5-6, respectively.

Advantageously, the linear slide damper assembly 30 reduces the height required to mount the damper between the water heater 22 and the draft hood 26, as compared to conventional rotating damper assemblies having blades that rotate circumferentially at least partially in a vertical direction between the water heater and draft hood.

As another advantage, the damper blade 32 of the present embodiments is entirely removed from the air stream of the flue passage 24 when in the open state, as seen in FIGS. 6A-6B. Such design of the present embodiments is expected to reduce flow obstruction during operation of the water heater 22 as compared to a conventional rotating damper blade that is positioned partially within the flue passage.

As a further advantage, the present linear damper system can allow at least a 5 degree variation, and up to a 20 degree or more variation, in the position of the drive member 40 while still maintaining a completely open state, as depicted in the different open states of FIGS. 6A-6B. In particular, the flue passage 24 is entirely open in both FIG. 6A and FIG. 6B, even when there is a relatively large degree of variation of the rotational position of the drive member 40. In contrast, a typical rotary drive damper uses a cam or other mechanical position indicators to position the damper blade in the open position vertically within the flue passage, and in such systems the desired positional tolerance is plus or minus 3 degrees, which requires precision components and limits the type of drive motors that can be used.

In short, the combination of the drive member 40 being coupled to the damper blade 32 reduces the stopping position accuracy required by the actuation components, e.g., including a motor, which increases the allowable tolerance. Such design allows for the use of simple controls to operate a DC volt operated motor, which can continue to rotate after power is removed due to the residual magnet field of the motor dissipating.

Figure 7A:
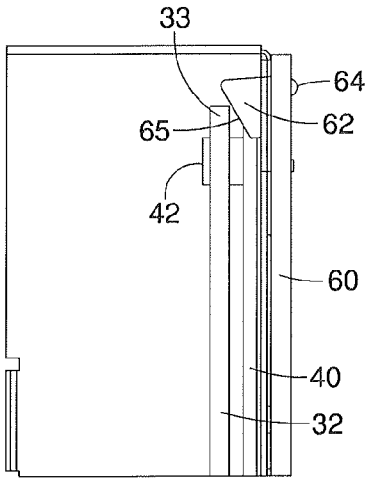
FIGS. 7A-7B are side schematic views illustrating a portion of the linear slide damper in different states of engagement with a switch.
Figure 7B:
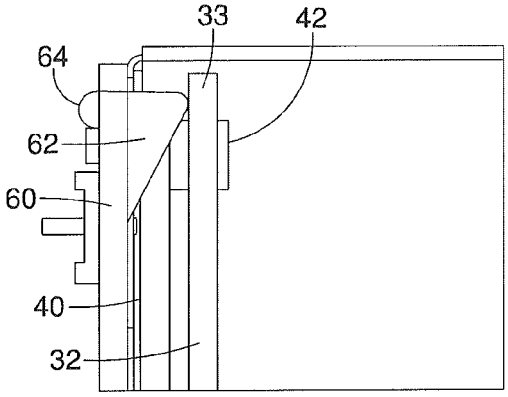
Figure 8:
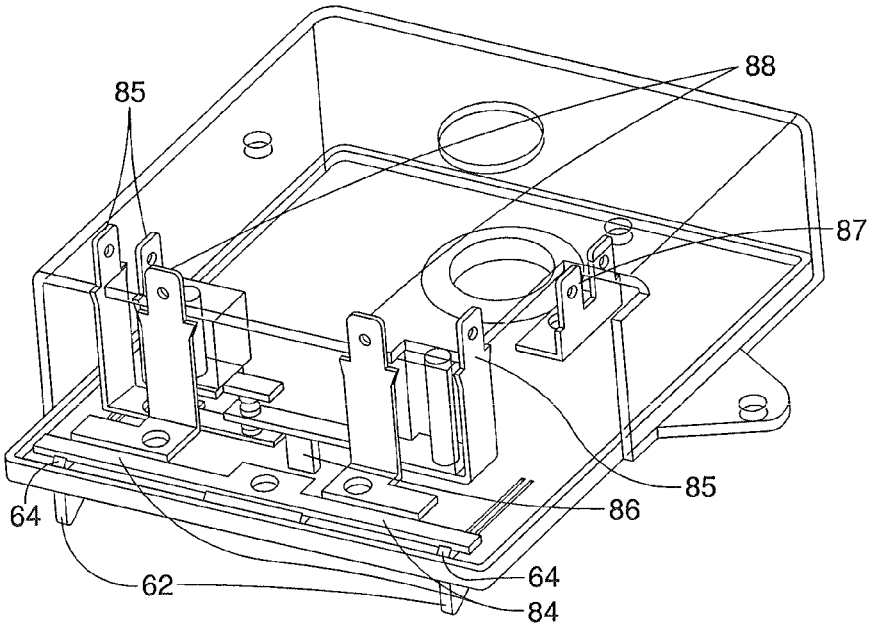
FIG. 8 is a schematic perspective view of exemplary connections suitable for use with the linear slide damper.

Referring to FIGS. 7A-7B, a portion of the linear slide damper assembly 30 is shown in different states of engagement with a switch. The linear slide damper design uses the first end 33 of the damper blade 32 to indicate the open position of the damper. FIG. 7A shows the first end 33 of the damper blade 32 about to contact a tapered segment 62 on a switch activation arm 60, while FIG. 7B shows the first end 33 of the damper blade 32 being pushed into full engagement with the tapered segment 62 of the switch activation arm 60. The state of FIG. 7B corresponds to the states of FIGS. 6A-6B, in which the damper blade 32 is in the open state. In the open state, the damper blade 32 may move the tapered segment 62 of the switch activation arm 60 in a direction or manner such that a switch activation point 64 of the switch activation arm 60 becomes fully engaged with damper position switch contacts 84, as shown in FIG. 8 below. The periodic connection between the switch activation point 64 and the damper position switch contacts 84 provides a signal confirming that the damper blade 32 is in the open position.

Advantageously, the technique shown in FIGS. 7A-7B ensures that the damper blade 32 is in the open position before the burner operates by providing direct contact of the damper blade 32 itself with position sensing controls. This ensures that the damper blade 32 is in the fully open state before allowing the water heater burner to fire. In contrast, typically on rotary style dampers, the open position of the damper is indicated by a lobe on a cam device connected between the drive motor and the shaft of the damper, and there is no direct indicator to ensure the damper blade is opened completely because the positional indicator is attached to the drive unit and not to the damper blade itself.

Referring to FIG. 8, a schematic view of exemplary connections suitable for use with the linear slide damper assembly 30 are shown and described. The exemplary connections comprise damper position switch contacts 84, motor power connections 85, motor operation activation arm 86, neutral power and motor connection 87, and damper blade position circuit connections 88.

The motor position is controlled by the motor operation activation arm 86. When the damper blade 32 is in the closed position, the motor power connections 85 are coupled to the normally closed connection, which allows power to be applied to the motor to drive the damper blade 32 to the open position. When the damper blade 32 reaches the fully open state, the switch activation arm 60 is engaged, as explained in FIG. 7B above, to switch the contact from the closed to the open contact, which stops the motor rotation. The damper is driven closed by applying power to the normally open contact, and once the damper reaches the full closed position the motor activation arm moves off the tapered segment 64 on the drive arm, which resets the motor drive circuit to the closed position.

As noted in FIGS. 7A-7B above, the open position of the damper blade 32 is verified by the activation of a pair of contacts 64, which are engaged when the damper blade 32 is in the open state. While the exemplary system of FIG. 8 shows the use of simple contacts to operate the damper and to prove the damper open position, these contacts could be substituted with micro switches or magnetic reed switches if small magnets are added to the ends of the switch and motor activation arms.

While various embodiments of the invention have been described, the invention is not to be restricted except in light of the attached claims and their equivalents. Moreover, the advantages described herein are not necessarily the only advantages of the invention and it is not necessarily expected that every embodiment of the invention will achieve all of the advantages described.

We claim:

1. A damper system for use with a heating device having an upper surface, the damper system comprising:

a damper blade having open and closed states, wherein the damper blade is movable in a linear direction only between the open and closed states;

a cover enclosing the damper blade, wherein the cover is configured to be mounted to the upper surface of the heating device; and a drive member coupled to the damper blade, wherein rotation of the drive member in a circumferential direction imparts linear motion of the damper blade, wherein the damper blade comprises first and second ends, a solid segment disposed at the second end, and a slot disposed at the first end, wherein the drive member further comprises at least one pin disposed for movement within the slot of the damper blade.

2. The system of claim 1, wherein the damper blade comprises a rectangular shape.

3. The system of claim 1, wherein a circumferential position of the drive member is configured to vary by at least 5 degrees while the damper blade remains in a fully open state.

4. The system of claim 1, wherein the damper blade fully overlaps with a flue passage in the closed state, and wherein the damper blade lacks any overlap with the flue passage in the open state.

5. The system of claim 1, wherein a portion of the damper blade directly contacts a switch activation arm in the open state, wherein the switch activation arm confirms the open state of the damper blade.

6. The system of claim 5, wherein a first end of the damper blade contacts a tapered segment of the switch activation arm when the damper blade is in the open state.

7. A damper system, comprising:

a damper blade having open and closed states;

a drive member coupled to the damper blade, wherein rotation of the drive member in a circumferential direction imparts linear motion of the damper blade; and wherein the drive member further comprises at least one pin disposed for movement laterally within a slot of the damper blade.

8. The system of claim 7, wherein the damper blade is movable in a linear direction only between the open and closed states.

9. The system of claim 7, wherein the damper blade comprises a rectangular shape.

10. The system of claim 7, wherein the damper blade comprises first and second ends, a solid segment disposed at the second end, and wherein the slot is disposed at the first end.

11. The system of claim 7, wherein a portion of the damper blade directly contacts a switch activation arm in the open state, wherein the switch activation arm confirms the open state of the damper blade.

12. A damper system for use with a heating device having a flue passage, the damper system comprising:

a damper blade having open and closed states, wherein a portion of the damper blade directly contacts a switch activation arm at a location outside of the flue passage in the open state, wherein the switch activation arm confirms the open state of the damper blade; and a drive member coupled to the damper blade, wherein rotation of the drive member in a circumferential direction imparts linear motion of the damper blade, wherein the damper blade comprises first and second ends, a solid segment disposed at the second end, and a slot disposed at the first end, wherein the drive member further comprises at least one pin disposed for movement within the slot of the damper blade.

13. The system of claim 12, wherein the damper blade is movable in a linear direction only between the open and closed states.

14. The system of claim 12, wherein the damper blade comprises a rectangular shape.

15. The system of claim 12, wherein the damper blade fully overlaps with a flue passage in the closed state, and wherein the damper blade lacks any overlap with the flue passage in the open state.

* * * * *